US005884842A

United States Patent [19]

Caine et al.

[11] Patent Number: 5,884,842

[45] Date of Patent: Mar. 23, 1999

[54] TANK CLEANING TOOL

[75] Inventors: Donald R. Caine, Greensboro; Norman P. Geible, Kernersville; Anthony D. Moore, Winston-Salem, all of N.C.

[73] Assignee: CAMCO Manufacturing, Inc., Greensboro, N.C.

[21] Appl. No.: 779,444

[22] Filed: Jan. 7, 1997

[51] Int. Cl.[6] ..... B05B 3/06

[52] U.S. Cl. ..... 239/251; 239/288.5; 4/255.04; 4/255.08; 134/167 R; 134/168 R

[58] Field of Search ..... 239/251, 288, 239/288.3, 288.5, 525, 588; 138/129, 132–134; 134/167 R, 168 R; 4/255.04, 255.08

[56] References Cited

U.S. PATENT DOCUMENTS

| | | | |
|---|---|---|---|
| D. 357,097 | 4/1995 | Lee . | |
| D. 362,935 | 10/1995 | Lee . | |
| 2,061,987 | 11/1936 | Sorensen | 239/588 X |
| 2,283,780 | 5/1942 | Ahern | 134/168 R |
| 3,023,428 | 3/1962 | Otteson | 4/255.04 |
| 3,331,456 | 7/1967 | Pittman | 239/288.5 X |
| 3,994,310 | 11/1976 | Brandon | 239/288.3 X |
| 4,865,257 | 9/1989 | Bailey | 239/288.5 |
| 5,135,015 | 8/1992 | Young | 239/288.5 X |
| 5,253,664 | 10/1993 | Wilson | 239/251 X |
| 5,497,514 | 3/1996 | Miller | 4/255.04 |
| 5,573,187 | 11/1996 | Proctor | 134/167 X |

OTHER PUBLICATIONS

P. 1 from Valterra Products, Inc., 1996 RV catalog showing "Rinse–A–Tank" wand.

Photocopies of four pages from Camping World, Inc., catalog with p. 386 showing two holding tank rod cleaners (undated).

CAMCO Manufacturing, Inc. RV Products Catalog (undated).

*Primary Examiner*—Andres Kashnikow
*Assistant Examiner*—Steven J. Ganey

[57] ABSTRACT

A tubular tank cleaning tool for use in an R.V. waste storage tank or the like is provided with a rotating nozzle affixed to a tubular body for connection at its opposite end to a conventional garden hose. The improvement includes a flexible section of the tubular body having a coil spring within to allow the tool to be easily bent around corners and tight angles. The coil spring prevents the flexible section from kinking while a nozzle guard at the distal end of the tubular body prevents the nozzle from catching as the tool is inserted or withdrawn from a waste storage tank.

6 Claims, 2 Drawing Sheets

TANK CLEANING TOOL

BACKGROUND OF THE INVENTION

1. Field of the Invention

The invention herein pertains to cleaning tools for recreational vehicle (RV) waste tanks and the like, and particularly pertains to cleaning tools having rotating nozzles which are attached to flexible water hoses.

2. Description of the Prior Art and Objectives of the Invention

Cleaning tools for use in RV waste collection and storage tanks and otherwise have become increasingly popular in recent years with more and more people using recreational vehicles for travel and leisure purposes. Garden and other hoses are threadably attached to the handle end of such tubular cleaning tools, sometimes referred to as "wands", which may have a rotating nozzle for spraying clean water at a relatively high pressure. Such cleaning tools are inserted through the commode bowl, and drain pipe into the waste collection tank below whereby the tank can be rinsed free of bacteria containing sludge. Such cleaning tools are generally formed from a straight plastic tube having a diameter comparable to the attached water hose and usually, but not always, include an opening for spraying water to assist in the cleaning operation. It is not uncommon to encounter a bend in the drain pipe or connection between the toilet bowl and tank, making the cleaning job more difficult, especially with a rigid, linear cleaning tool. In addition, certain tanks are installed with an offset which can cause problems when the cleaning tool is removed, since the offset may have edges which catch the tool nozzle as it is being withdrawn, causing the nozzle to bend or break. Also, tank cleaning tools are regularly used for other cleaning purposes, for example, to clean gray water drainage lines and other fittings. Thus, conventional, rigid cleaning tools are limited in their uses and it is therefore one objective of the present invention to provide a cleaning tool which is more versatile and convenient to use than cleaning tools now on the market.

It is another objective of the present invention to provide a tank cleaning tool which includes a flexible tubular section to allow the tool to be curved or bent during use.

It is still another objective of the present invention to provide a cleaning tool having a resilient coiled spring within the flexible section to prevent the section from kinking, thus stopping the flow of water therethrough during use.

It is yet a further objective of the present invention to provide a tank cleaning tool which includes a nozzle guard which will help prevent damage to the nozzle as it is being inserted or removed from a sewage storage tank or otherwise.

Various other objectives and advantages of the present invention will become apparent to those skilled in the art as a more detailed description is set forth below.

SUMMARY OF THE INVENTION

The aforesaid and other objectives are realized by providing a tank cleaning tool having first and second rigid tubular sections and a flexible tubular section connected therebetween. The flexible section which contains a coil spring, allows water to flow through the tubular body of the tool without interruption even when the flexible section is curved or bent during use. A standard rotatable nozzle positioned at the distal end provides streams of high pressure water for cleaning toilet drains and sewage tanks as are conventional on recreational vehicles. A conical nozzle guard is also provided which shields the nozzle from impact and damage during withdrawal after use, such as from a pipe or tank. The tubular body can be threadably attached to a garden hose as is standard in the trade, proximate a cutoff valve near the handle.

DETAILED DESCRIPTION OF THE PREFERRED EMBODIMENT AND OPERATION OF THE INVENTION

Figure 4:
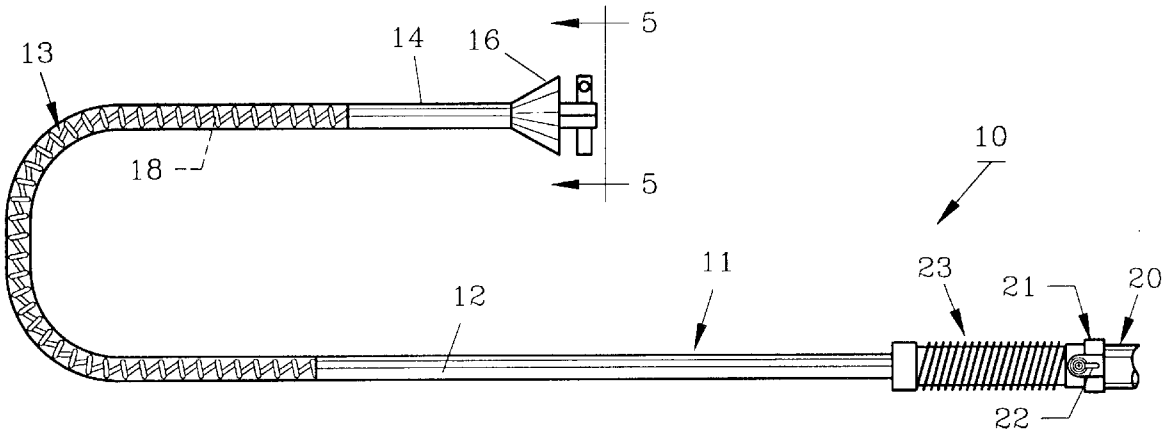
FIG. 4 depicts the tank cleaning tool of FIG. 1 in a severely bent or curved configuration.
Figure 5:
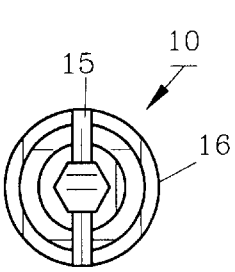
FIG. 5 demonstrates an enlarged end view of the nozzle as seen along lines 5—5 of FIG. 4.
Figure 2:
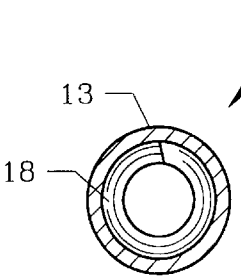
FIG. 2 shows an enlarged cross-sectional view of the tank cleaning tool as seen FIG. 1 along lines 2—2.
Figure 1:
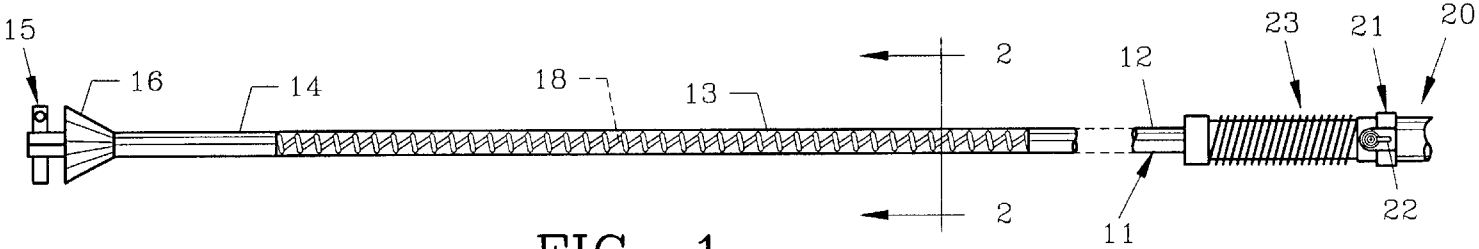
FIG. 1 illustrates the preferred form of the invention in a fragmented, linear or unbent posture.

For a better understanding of the invention and its use, turning now to the drawings, the preferred form of tank cleaning tool 10 is shown in FIGS. 1–5. As seen in FIG. 1, cleaning tool 10 has a tubular body 11 consisting of first rigid section 12, a middle transparent flexible section 13 and a second rigid section 14. At the distal end of second rigid section 14 a conventional rotating spray nozzle 15 is affixed as is standard in the industry. Immediately above (upstream of) nozzle 15 and located on second rigid section 14 is nozzle guard 16 which, as shown in FIGS. 1 and 5, is conically shaped. Cleaning tool 10 can be threadably connected to the male end of a conventional water hose, such as garden hose 20. Garden hose 20 is affixed to female coupler 21 having a manual cutoff valve 22 as is commonly used. Rigid section 12 also includes at its proximal end a ribbed vinyl handle 23 which assists in holding cleaning tool 10.

Figure 3:
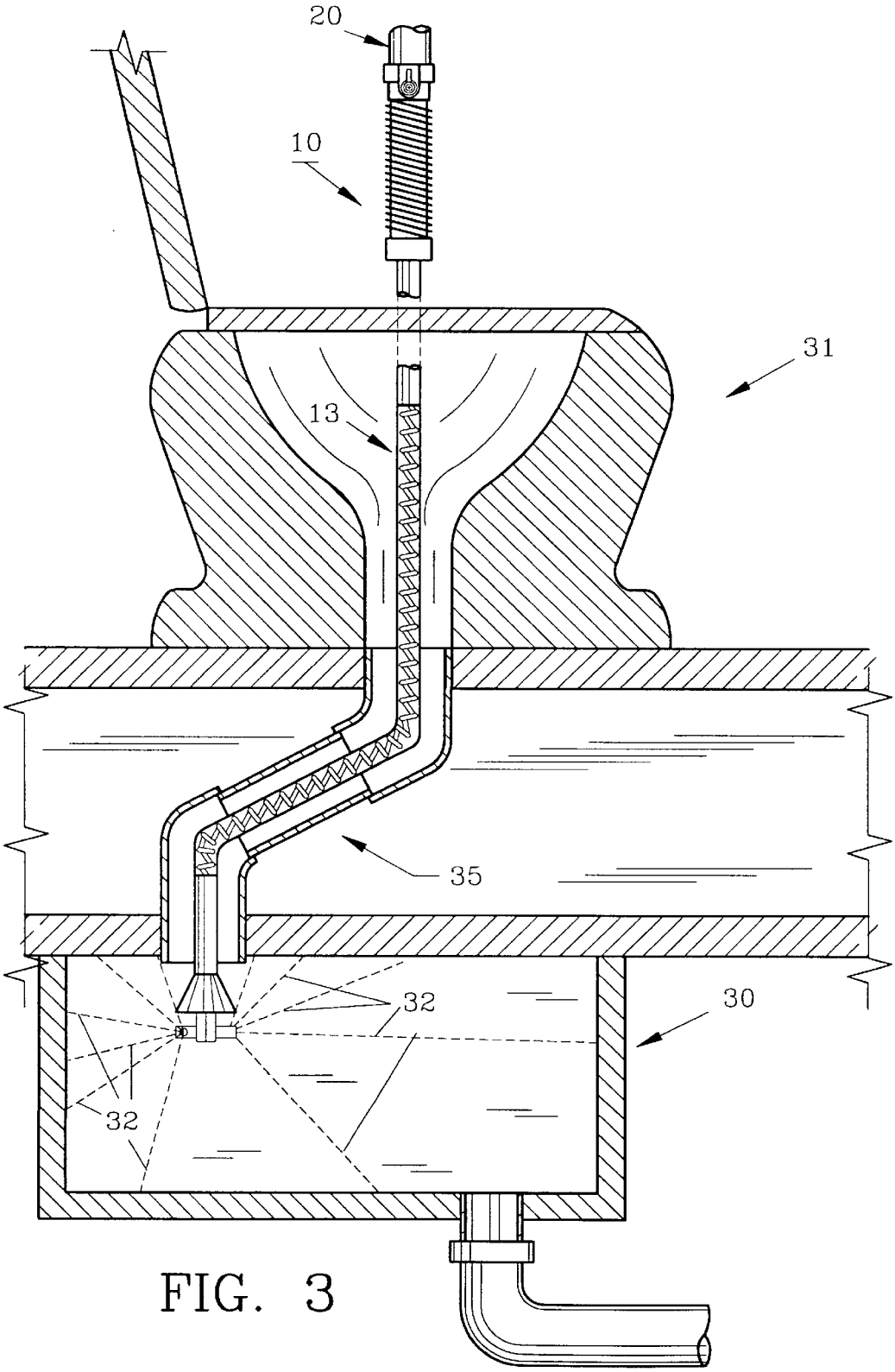
FIG. 3 pictures the tank cleaning tool of FIG. 1 as in use in a sewage collection tank.

As it is often necessary when cleaning waste holding tanks, such as RV waste collection and storage tank 30 as shown in FIG. 3, to bend or curve the cleaning tool for greater convenience, flexible section 13 provides this ability. Rigid drainpipe 35 has several bends which cleaning tool 10 can easily navigate due to its flexibility.

As depicted in FIG. 4, flexible section 13 is formed from a strong transparent polymeric tubing and contains resilient coil spring 18. Coil spring 18 is preferably formed from stainless steel to prevent oxidation or corrosion and to maintain flexible section 13 open for water flow when bending cleaning tool 10 as shown in FIGS. 3 and 4. In addition to the advantages of flexible section 13 of tubular body 11, packaging, shipping and storage of cleaning tool 10 can be more easily accomplished as flexible section 13 allows cleaning tool 10 to be bent or coiled for compactness. Cleaning tool 10 is preferably about 1.4 meters in length with flexible section 13 having a length of approximately 0.82 meters with first rigid section 12 having a length of approximately 0.51 meters and second rigid section 14 having a length of approximately 14 centimeters. The internal diameter of cleaning tool 10 is approximately 17 mm, although the exact internal diameter will vary depending on the thicknesses of the walls of the various sections and the diameter of coil spring 18. As would be understood, coil spring 18 allows sharp bending of flexible section 13 as shown in FIG. 4 while preventing kinking of flexible section 13 to allow water to freely pass through nozzle 15 without interruption.

Nozzle guard 16, like rigid sections 12 and 14, is formed from a relatively high impact plastic and extends radially from second rigid section 14 as shown in FIG. 1 and is approximately the same width as rotating nozzle 15. Thus, as cleaning tool 10 is removed from a tank, through pipes or the like, nozzle guard 16 protects nozzle 15 from impact and prevents nozzle 15 from catching as cleaning tool 10 is being removed from, for example, tank 30 and commode 31 in FIG. 3. Water stream 32 impacts the walls of waste tank 30 for cleaning purposes as seen therein.

Various changes and improvements can be made to the preferred form of the invention as herein described and such changes and modifications are anticipated and the examples and illustrations are merely for illustrative purposes and are not intended to limit the scope of the appended claims.

I claim:

1. A tank cleaning tool for attachment to a water hose comprising:

a tubular body, said tubular body comprising a first rigid section, a flexible section, said flexible section connected to said first rigid section;

a second rigid section, said second rigid section substantially shorter than said first rigid section, said second rigid section connected to said flexible section;

a nozzle, said nozzle attached to said second rigid section;

a smooth, continuous, rigid, conically shaped nozzle guard, said nozzle guard positioned on said second rigid section, proximate and extending towards said nozzle, said nozzle guard positioned upstream of said nozzle so as to allow an unimpeded radially outward flow of water from said nozzle; and a resilient member, said resilient member positioned within said flexible section.

2. The tank cleaning tool of claim 1 wherein said nozzle rotates.

3. The tank cleaning tool of claim 2 wherein said resilient member comprises a coil spring.

4. The tank cleaning tool of claim 3 wherein said coil spring is formed from stainless steel.

5. The tank cleaning tool of claim 4 wherein said nozzle guard is approximately the same width as said nozzle.

6. The tank cleaning tool of claim 5 wherein said nozzle guard is continuously affixed to said second rigid section, said nozzle guard smoothly exteriorly shaped so as to provide an exterior surface which protects said nozzle from impact and catching as the cleaning tool is being removed from the tank.

* * * * *